US006379182B1

(12) United States Patent
Byrne

(10) Patent No.: US 6,379,182 B1
(45) **Date of Patent: *Apr. 30, 2002**

(54) ENERGY CENTER WITH INTERCHANGEABLE SUPPORT BASES

(76) Inventor: Norman R. Byrne, 2736 Honey Creek, NE., Ada, MI (US) 49301

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/200,696

(22) Filed: Nov. 27, 1998

(51) Int. Cl.[7] ..... H01R 13/73
(52) U.S. Cl. ..... 439/574
(58) Field of Search ..... 439/535, 574, 439/532

(56) References Cited

U.S. PATENT DOCUMENTS

| | | | | | |
|---|---|---|---|---|---|
| 4,266,266 A | | 5/1981 | Sanner | 174/38 |
| 4,747,788 A | * | 5/1988 | Byrne | 439/531 |
| 5,195,288 A | | 3/1993 | Penczak | 52/220.1 |
| 5,351,173 A | * | 9/1994 | Byrne | 439/131 |
| D355,890 S | | 2/1995 | Lentz | D13/143 |
| 5,404,279 A | | 4/1995 | Wood | 362/145 |
| 5,472,157 A | * | 12/1995 | Lehrman | 439/574 |
| 5,501,614 A | * | 3/1996 | Tsuchiya | 439/574 |

* cited by examiner

*Primary Examiner*—Gary Paumen
(74) *Attorney, Agent, or Firm*—Varnum, Riddering, Schmidt & Howlett LLP

(57) ABSTRACT

An energy center (100) is disclosed which is mountable to furniture assemblies comprising elements such as planar work surfaces and vertical side surfaces. In one embodiment, the energy center (100) is mountable to a work surface (102) having a planar surface (104). A slot (106) extends through the work surface (102). The energy center (100) includes an upper housing (120) having an interior spacial area (124) for housing wires and portions of electrical receptacles (112) and data ports (114). The receptacles (112) and data ports (114) are utilized to provide energy through power cords (110) and data lines (108). The upper housing (120) is interchangeably mountable to a first base support (130). The base support (130) is securable to the planar surface (140). In a second embodiment, an energy center (300) is adapted to be mounted to an edge or end of the work surface (102). The energy center (300) utilizes the same upper housing (120), but is releasably interchangeable with a second base support (310) which is in the form of a clamping device (312) utilized for purposes of releasably securing the energy center (300) to an edge of the work surface (102).

12 Claims, 9 Drawing Sheets

ENERGY CENTER WITH INTERCHANGEABLE SUPPORT BASES

BACKGROUND OF THE INVENTION

1. Field of the Invention

The invention relates to energy centers and, more particularly, to energy centers which are mountable in or to furniture assemblies, work surfaces and the like.

2. Description of Related Art

Efficient organization of devices requiring electrical power within an office, commercial, industrial or residential environment has been a historical problem. Such devices include lamps, typewriters and the like. More recently, this problem has been exacerbated by the proliferation of additional devices for communications, such as complex telephone stations, computers, video displays and the like. The primary problems associated with the efficient organization and use of such devices relate to the abundance of wiring arrays and the positioning of the energy-requiring devices within the environment, particularly in office environments.

Historically, telephone terminals and electrical receptacles have long been used for providing convenient, floor-level interconnection nodes for connecting telephones, computers and other electrical devices to the communications and electrical networks. In modern times, these types of communication lines, in particular, have proliferated. Many commercial and industrial, and some residential, environments now have a variety of communication networks. Many of the networks are internal and many are connected to external networks, such as telephone lines. These networks now include dedicated communication lines, video communications, computer networks, and fiber optics communications lines for various types of information.

A long-standing problem has been the efficient interconnection of these communications networks with the end use devices, such as telephones and computers. This is especially difficult in an office environment where it is desirable to eliminate tangled wiring arrays for both aesthetic and safety reasons. Currently, many offices have numerous wires running from each desk to wall-mounted data terminals for telephone, computer and other information and communication networks.

The problem of tangled wires in the office environment is even more pronounced when electrical wiring is added to the tangle of communications wires. In addition, it is well known that wiring costs can be relatively high if a sufficient number of terminals and receptacles are not utilized and properly positioned. However, the cost of the materials also rapidly increases as the number of receptacles is increased. In addition, and perhaps more importantly, the conventional design of terminals within wall or floor services, which are often a substantial distance from devices such as those employed on work surfaces (computer terminals, etc.), can cause relatively unsightly and sometimes dangerous wiring arrays, in addition to resultant entanglements of cords connected to these devices.

The problems of convenience, efficiency and aesthetics have been somewhat addressed in the electrical power arts. Several devices have been produced to bring the electrical terminals closer to the users in an aesthetically pleasing, efficient and convenient manner. The electrical arts tend to be ahead of the communication arts in this respect. In fact, the electrical arts have progressed to a point where electrical receptacles may be mounted on a work surface in a retractable manner, so that power cords may easily be connected to the electrical receptacles above the work surface, but both the cords and the receptacles may be retracted below the work surface while maintaining power to the user devices.

A One relatively substantial advance in the art relating to the mounting of electrical receptacles in a retractable manner in work surfaces and the like, is shown in the commonly owned U.S. Patent to Byrne 4,747,788 issued May 31, 1988. In the Byrne patent, a retractable power center includes a retainer housing formed in the work surface, with a clamping arrangement to secure the housing to the work surface. A lower extrusion is connected to a lower portion of the housing, and a manually movable power carriage mounts receptacles. In response to manual application of upward forces on the power carriage, the carriage may be raised upward into an extended, open position. Small bosses extending from the sides of the carriage, resting on the top portion of the housing, support the carriage in the extended, open position. In the open position, the user can energize desired electrical devices from the receptacles, and then lower the carriage into a releasably secured, retractable position.

The Byrne '788 patent represents a substantial advance with respect to retractable power centers mounted on work surfaces and the like. In addition to the Byrne '788 patent, another relatively substantial advance in the art is disclosed in the commonly owned U.S. Patent to Byrne 5,351,173 issued Sep. 27, 1994. In the Byrne '173 patent, a retractable communications terminal center includes voice/data terminals adapted to be mounted in a work surface. The communications terminal center includes a lighting arrangement for providing illumination in the vicinity of the energy center. A pivot arrangement is coupled to the lighting configuration and to the energy center power carriage so as to provide a positional adjustment of the lighting arrangement relative to the carriage.

In addition to retractable energy center configurations, it is believed that stationary configurations which are extremely accessible to electrical and communications devices on the work surface are also of primary importance. With respect to prior art energy centers, one disadvantage relates to the concept that such energy centers are not necessarily adjustable as to their particular position on or around a work surface. That is, for example, it may be preferable to have an energy center located adjacent an edge or vertical side surface of a work surface. For example, the Byrne '173 patent discloses the concept of employing an energy center which is adapted to mount to a vertical side surface of a work surface. This type of application can be utilized when it is not desirable to provide slots or other type of apertures within a work surface for purposes of mounting an energy center and extending power cords through the slots. However, it has heretofore been unknown to employ energy centers which can be interchangeable between stationary support housings adapted to be mounted over slots in a work surface, and support configurations which are adapted to mount to vertical side surfaces or edges of horizontally disposed work surfaces and the like.

SUMMARY OF THE INVENTION

An energy center in accordance with the invention overcomes these and other limitations by providing an energy center upper housing means for housing electrical and/or voice/data receptacles and communications terminals. Energy is supplied to the receptacles and terminals through power cords extending downwardly from the upper housing. The upper housing is adapted to be utilized with a first base support adapted to be mounted over a slot on a planar portion of a work surface. The upper housing is also adapted to be mounted interchangeably to a base support which is further adapted to be mounted to an edge of a planar work surface or a vertical side surface.

BRIEF DESCRIPTION OF THE DRAWINGS

The invention will now be described with reference to the drawings in which.

DESCRIPTION OF THE PREFERRED EMBODIMENTS

Figure 1:
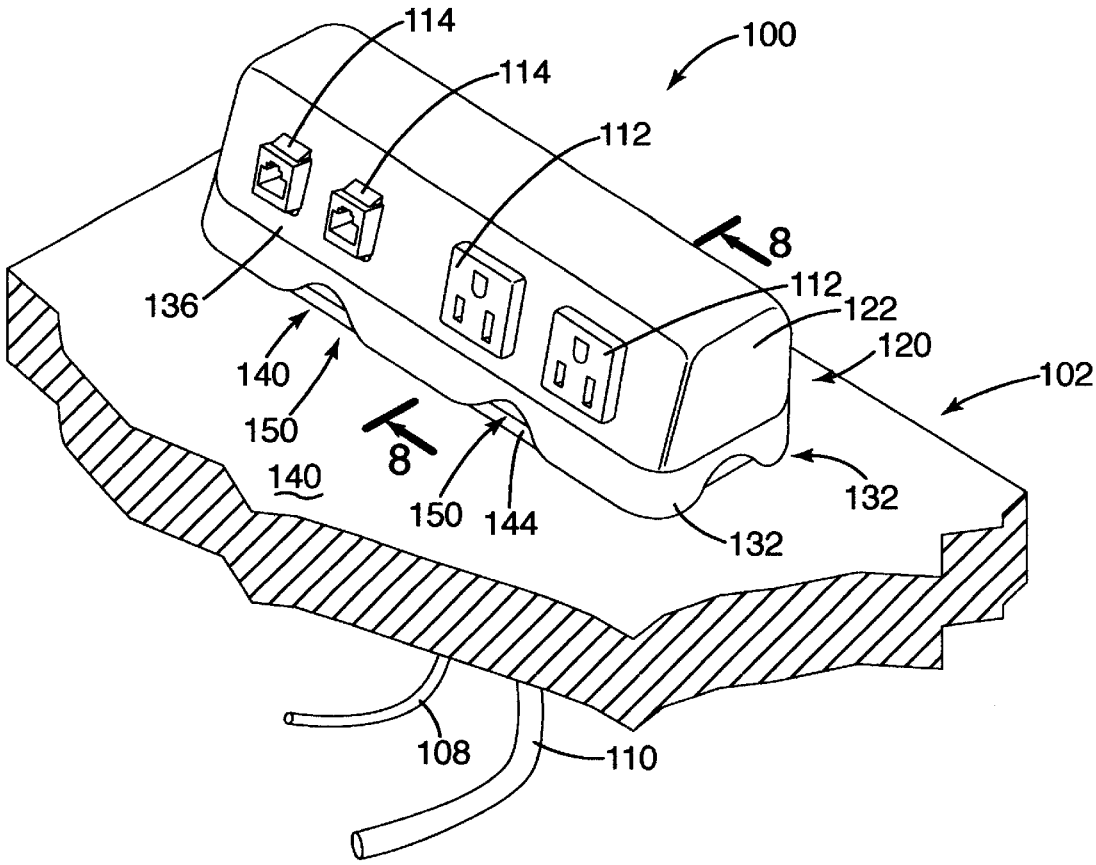
FIG. 1 is a perspective view of an energy center having an interchangeable base support, and mounted to a work surface which is shown in a partial breakaway format.
Figure 2:
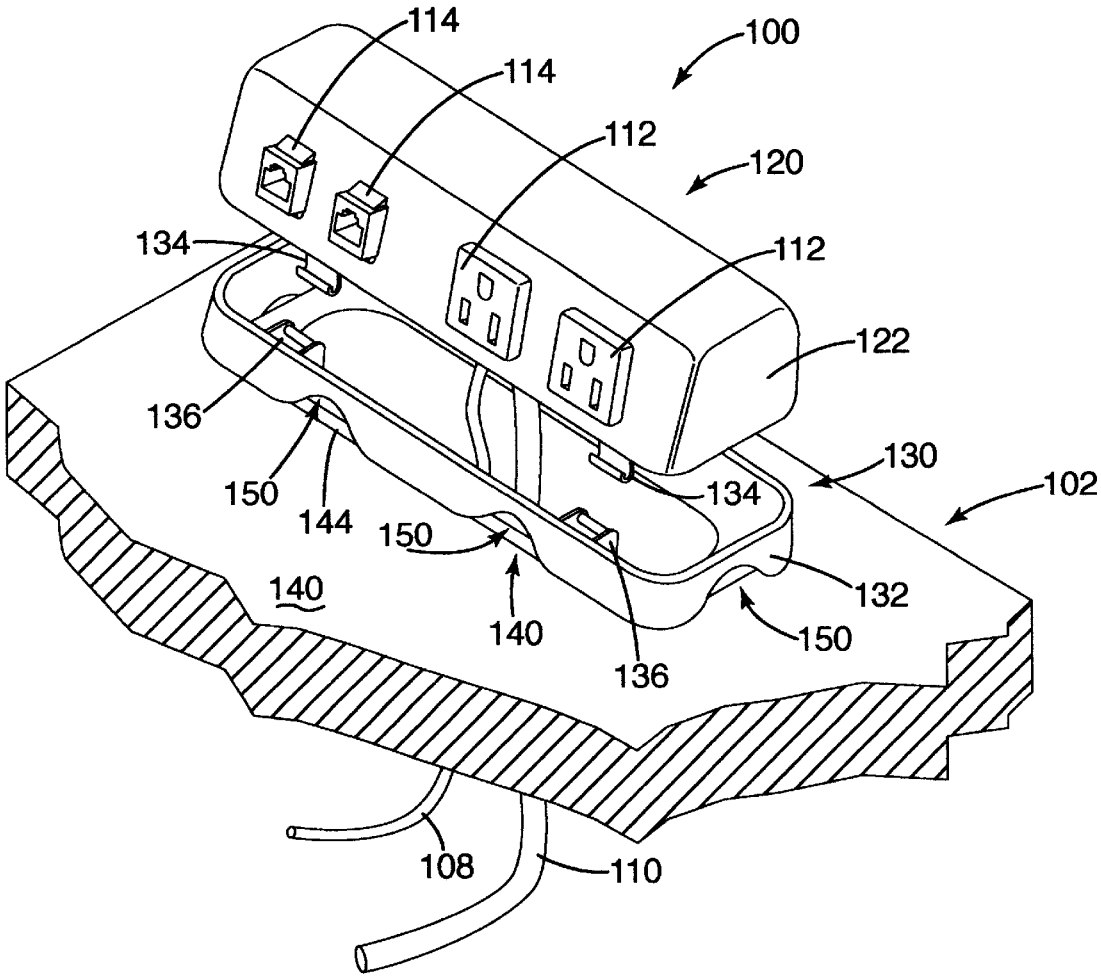
FIG. 2 is a partial exploded view of the energy center illustrated in FIG. 1, showing the energy center upper housing as separate from the energy center base support.

The principles of the invention are disclosed, by way of example, within an energy center 100 as depicted in FIGS. 1–8. The principles of the invention are also disclosed, by way of example, in a second embodiment of the invention as illustrated by energy center 300 as illustrated in FIGS. 9–17. With reference first to FIGS. 1–9, the energy center 100 is adapted to be mounted within a furniture component such as the work surface 102. The work surface 102 includes a planer surface 104. Within the planer surface 104 is a formed slot 106 (illustrated in FIG. 8) which extends through the work surface 102. The energy center 100 is adapted to accept energy through energized conductors such as the data lines 108 and the electrical power cords 110. Only one of each of the data lines 108 and power cords 110 is illustrated in FIG. 1 and the subsequent drawings. The work surface 102 can, for example, be the working surface of a desk or similar furniture component. Typically, the work surface 102 may have a veneer as its planar surface 104 or other conventional protective and aesthetically desirable surface secured to the top of the work surface 102.

Typically, the power cords 110 would be interconnected with a conventional power source located below the work surface 102. The power cords 110 will provide a relatively simplistic structure and aesthetically desirable means for transferring power from the conventional power source located below the work surface 102 (the power source not being shown) to one or more electrical outlet receptacles associated with the energy center 100, such as the electrical outlet receptacles 112. By "plugging in" to electrical outlet receptacles 112, other electrical devices (not shown) mounted on or near the work surface 102 may then be energized from the receptacles 112.

The data lines 108 can be interconnected to incoming voice/data nodes (not shown) also located below the work surface 102. As described in subsequent paragraphs herein, the data lines 108 can then be connected to the data ports 114. Through the use of the data ports 114, telephones, computer cable connectors or similar interconnections can be made for purposes of providing voice/data or similar communications to appropriate devices, such as telephones and computers.

Figure 8:
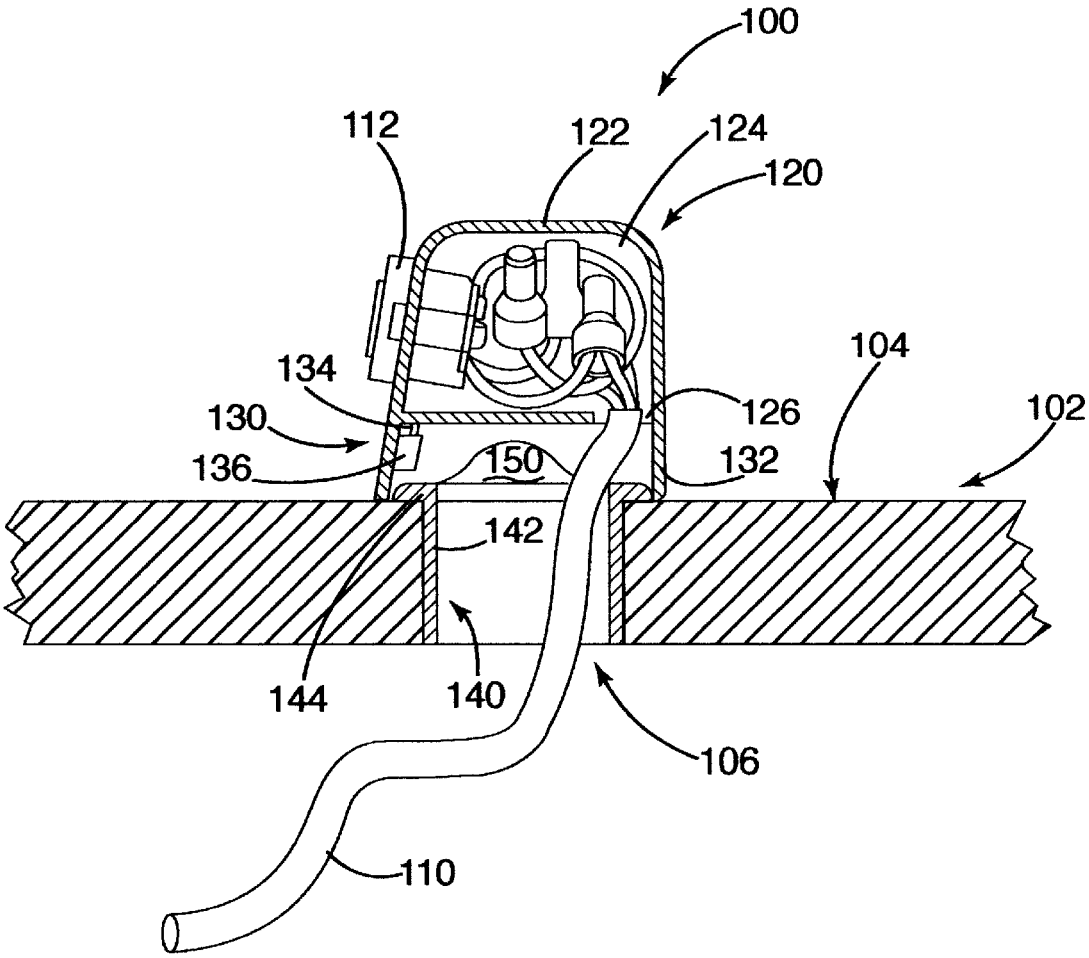
FIG. 8 is a sectional view of the energy center and work surface illustrated in FIG. 1, taken along section lines 8—8 of FIG. 1.
Figure 9:
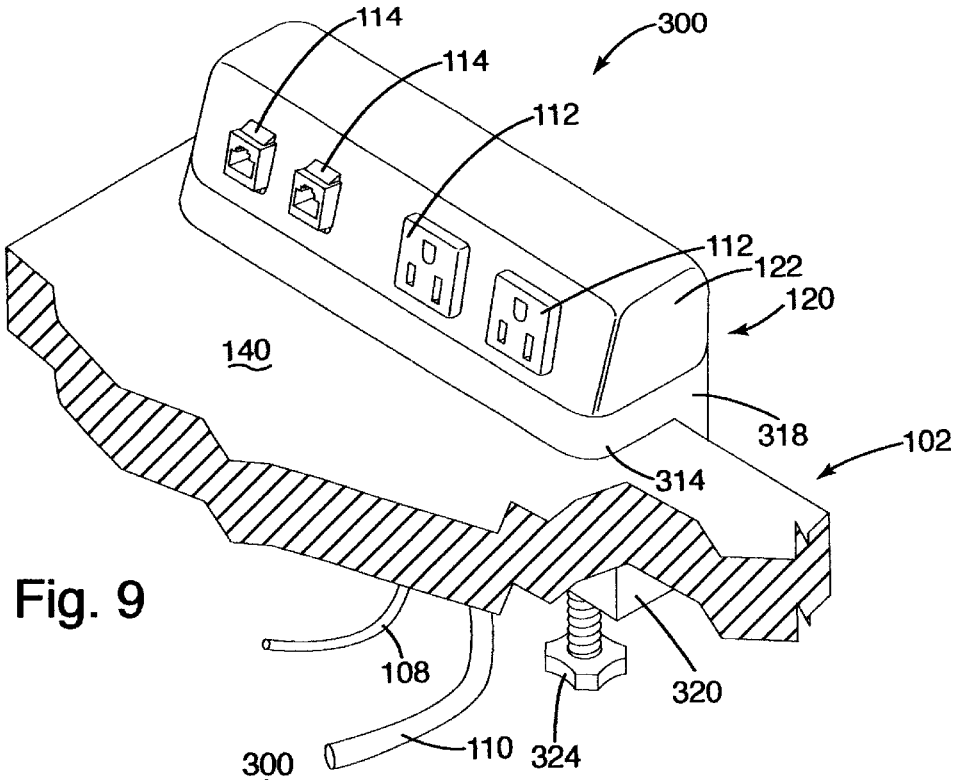
FIG. 9 is a perspective view of a second embodiment of an energy center with an interchangeable base support in accordance with the invention, and showing connection of the energy center to a work surface, with the work surface shown in a partial breakaway format.
Figure 10:
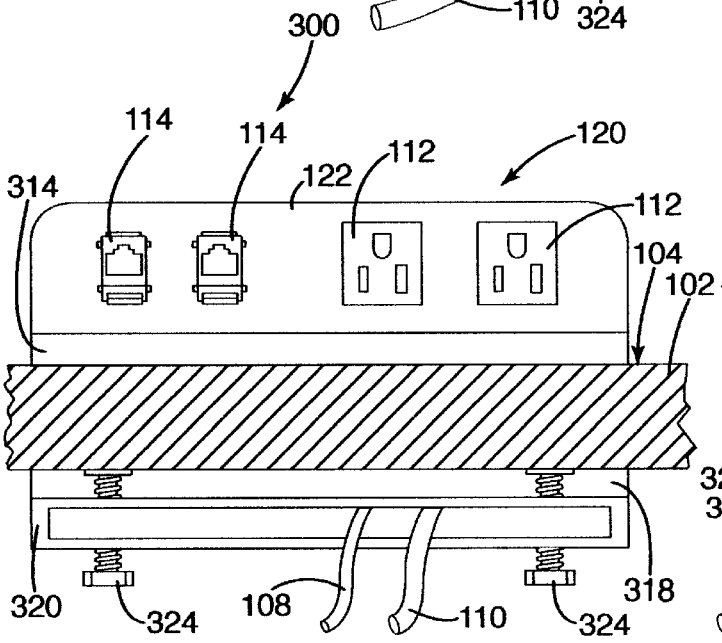
FIG. 10 is a front elevational view of the energy center and work surface shown in FIG. 9.
Figure 11:
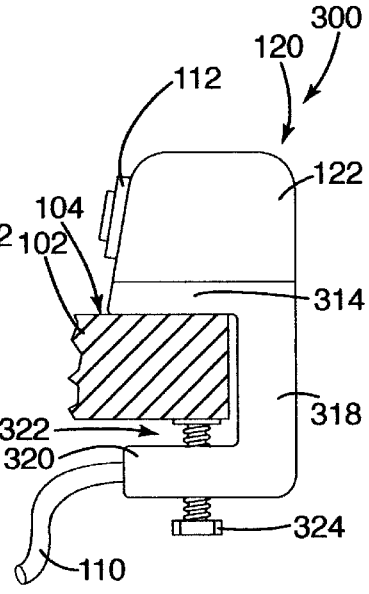
FIG. 11 is a side elevational view of the energy center and work surface shown in FIG. 9.

With reference primarily to FIGS. 1–3 and 8, the energy center 100 includes an energy center upper housing 120 comprising an outer shell 122. As shown in FIG. 8, the upper housing 120 includes an interior spacial area 124 for housing the appropriate electrical wires and portions of the electrical receptacles 112 and data ports 114 which are necessary for purposes of providing energy through the power cords 110 and data lines 108. The power cords 110 and data lines 108 access the spacial area 124 through an open slot area 126.

Figure 3:
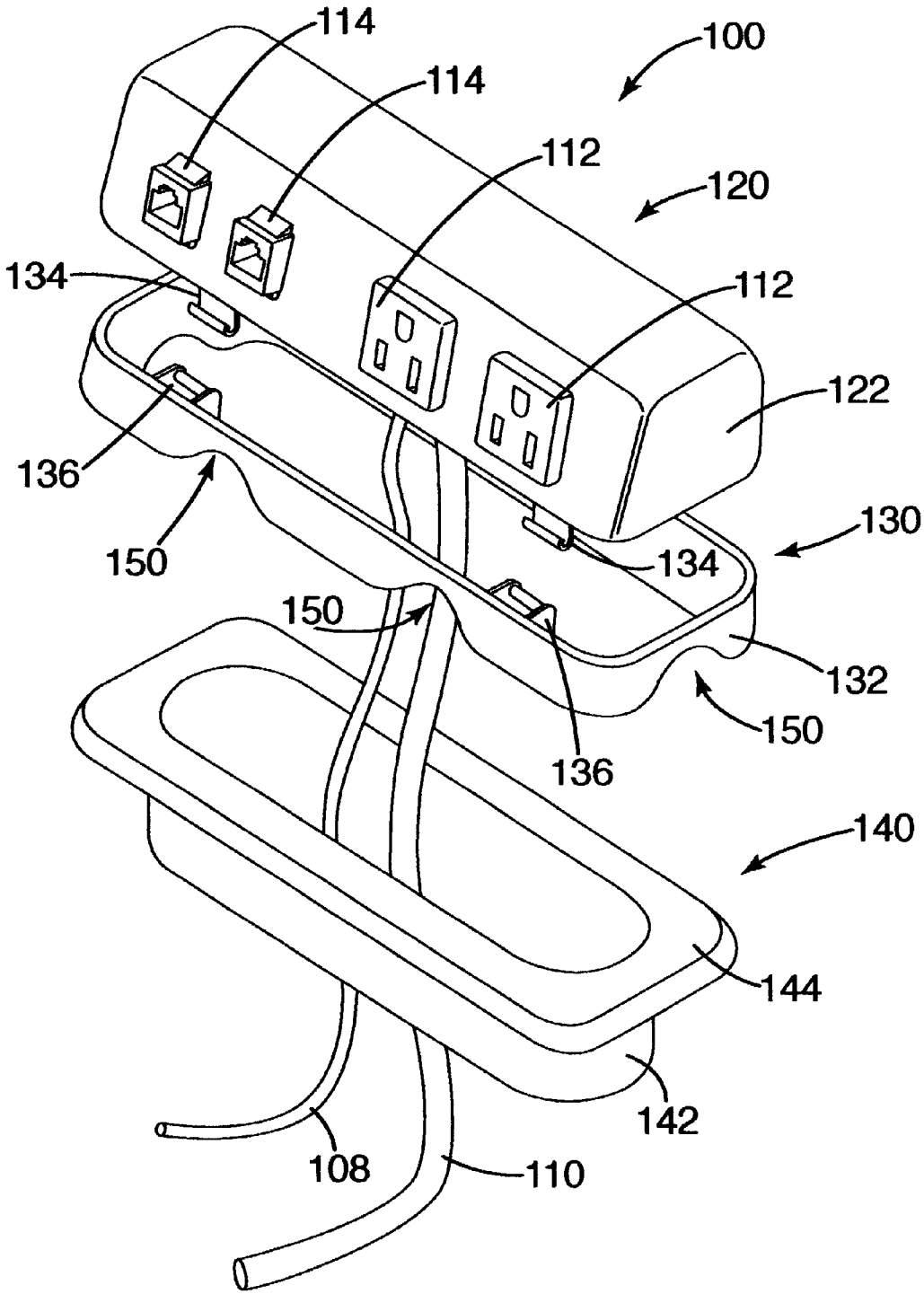
FIG. 3 is a further exploded view of the energy center illustrated in FIG. 1, showing the separate components comprising the energy center upper housing, the base support and the work surface grommet housing.
Figure 4:
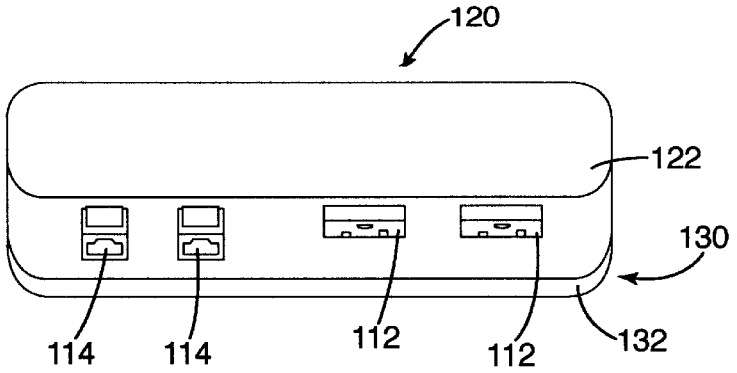
FIG. 4 is a plan view of the energy center upper housing.
Figure 5:
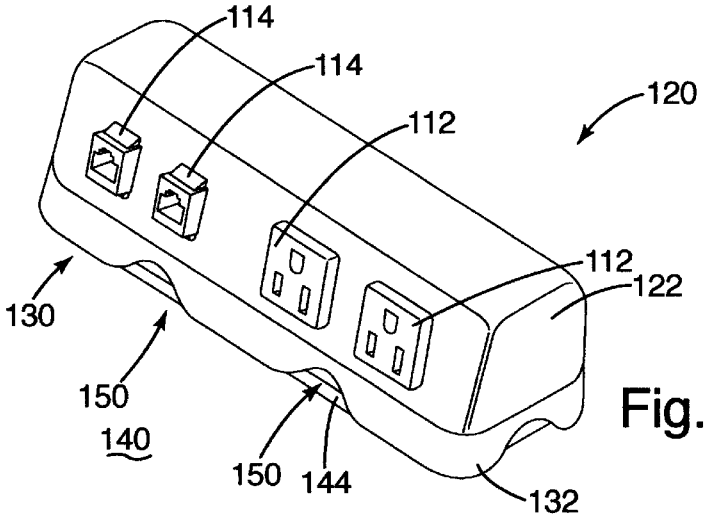
FIG. 5 is a perspective view of the energy center upper housing.
Figure 6:
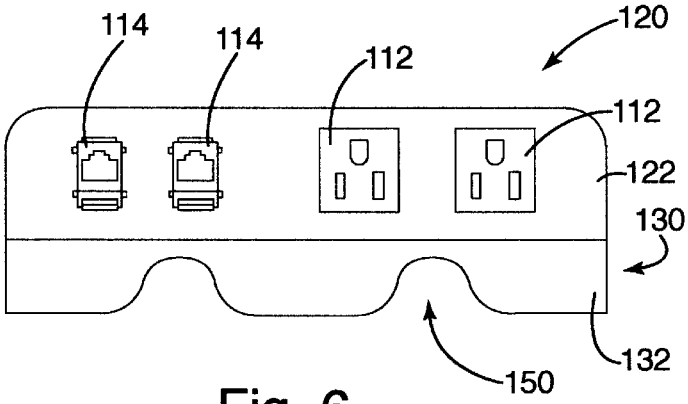
FIG. 6 is a front elevational view of the energy center upper housing.
Figure 7:
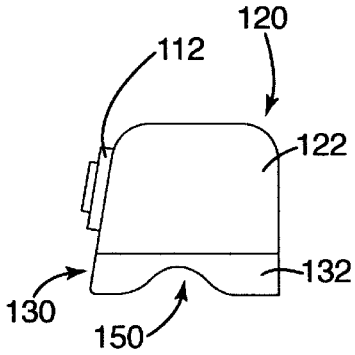
FIG. 7 is a side view of the energy center upper housing.

The energy center upper housing 120 is adapted to be mounted to a particular one of several base supports, such as the base support 130 primarily shown in FIG. 3. The base support 130 comprises a substantially rectangular shell portion 132 which is adapted to be releasably mounted to the energy center upper housing 120. The releasable mounting is provided through releasable connecting means such as the hooks 134 which are mounted to the lower frontal portion of the outer shell 122 of the energy center upper housing 120. The hooks 134 are adapted to be releasably secured to the hook retainers 136. The hook retainers 136 are mounted to the interior surface of a front portion of the shell 132 of the base support 130. It should be emphasized that many different kinds of connecting means can be utilized for purposes of releasably securing the energy center upper housing 120 to the base support 130. The hooks 134 and hook retainers 136 are merely an example of one type of connecting arrangement.

For purposes of providing an aesthetic and convenient means of extending the power cords 110 and data lines 108 up through the work surface 102, the slot 106 can be utilized with a grommet structure, such as the grommet structure 140 primarily illustrated in FIG. 3. The grommet structure 140 can be essentially shaped as illustrated in FIG. 3, and includes a vertically disposed casing structure 142, with the casing 142 extending downwardly into the slot 106 and forming the outer perimeter thereof.

Mounted to the upper edge of the casing portion 142, and potentially integral therewith, is a horizontally disposed collar 144. The horizontally disposed collar 144 has somewhat of a substantially rectangular configuration as primarily shown in FIG. 3. The slot 106 formed in the work surface 102 is configured to be somewhat slightly larger than the inner area formed by the casing 142. Accordingly, when the grommet structure 140 is mounted within the slot 106, the casing 142 is positioned below the planar surface 104. Correspondingly, the outer perimeter of the collar 144 overhangs the slot 106 so as to be positioned above the planar surface 104, with the lower surface of the collar 144 substantially flush with the planar surface 104. In this manner, the collar 144 provides a supporting surface for the grommet 140.

If desired, the grommet 140 can be rigidly secured to the work surface 102. Such arrangements are shown in the previously described and commonly owned U.S. Patents to Byrne 4,747,788 and 5,351,173.

If desired, the base support 130 of the energy center 100 can also be secured, either to the planar surface 104 or to the grommet 140. Specific securing arrangements are not illustrated in the drawings. Alternatively, it is also possible merely to position the energy center 100 over the slot 106 and grommet 140. In this manner, if desired, the energy center 100 can be selectively positioned over various other slots and grommets which may be positioned within the work surface 102.

It should be noted that with the particular energy center 100, comprising the upper housing 120 and the base support 130, the power cords 100 and data lines 108 are substantially hidden from view during use of the energy center. However, slots 150 may also be formed in the base support 130, and provide a means for extending power cords 110 and data lines 108 from atop the planar surface 104. The energy center 100 provides an aesthetically pleasing and functional energy center for use on a planar surface 104 of a work surface 102, without requiring substantial effort in moving the energy center 100 to other locations on the work surface 102, or otherwise connecting and disconnecting power cords and data lines associated with the same.

To illustrate a basic principle of the invention with respect to the interchangeability of base supports for the energy center, a second embodiment of an energy center according to the invention is shown by the energy center 300 illustrated in FIGS. 9–17. For purposes of description, components of the energy center 300 identical to components of the energy center 100 will be referenced with like numerals.

As with the energy center 100 previously described with respect to FIGS. 1–8, the energy center 300 is adapted to be utilized with a work surface 102 having a planar surface 104. However, unlike the previously described energy center 100 with the base support 130, the energy center 300 is adapted to be mounted to an edge or end of the work surface 102, as particularly shown in FIGS. 9 and 11. Also, as with the energy center 100, the energy center 300 includes an energy center upper housing 120 having an outer shell 122. The energy center upper housing 120 mounts electrical receptacles 112 and data ports 114 in a conventional manner. The electrical receptacles 112 are electrically interconnected to the power cord 110, while the data ports 114 are connected for communications with the data line 108.

Figure 12:
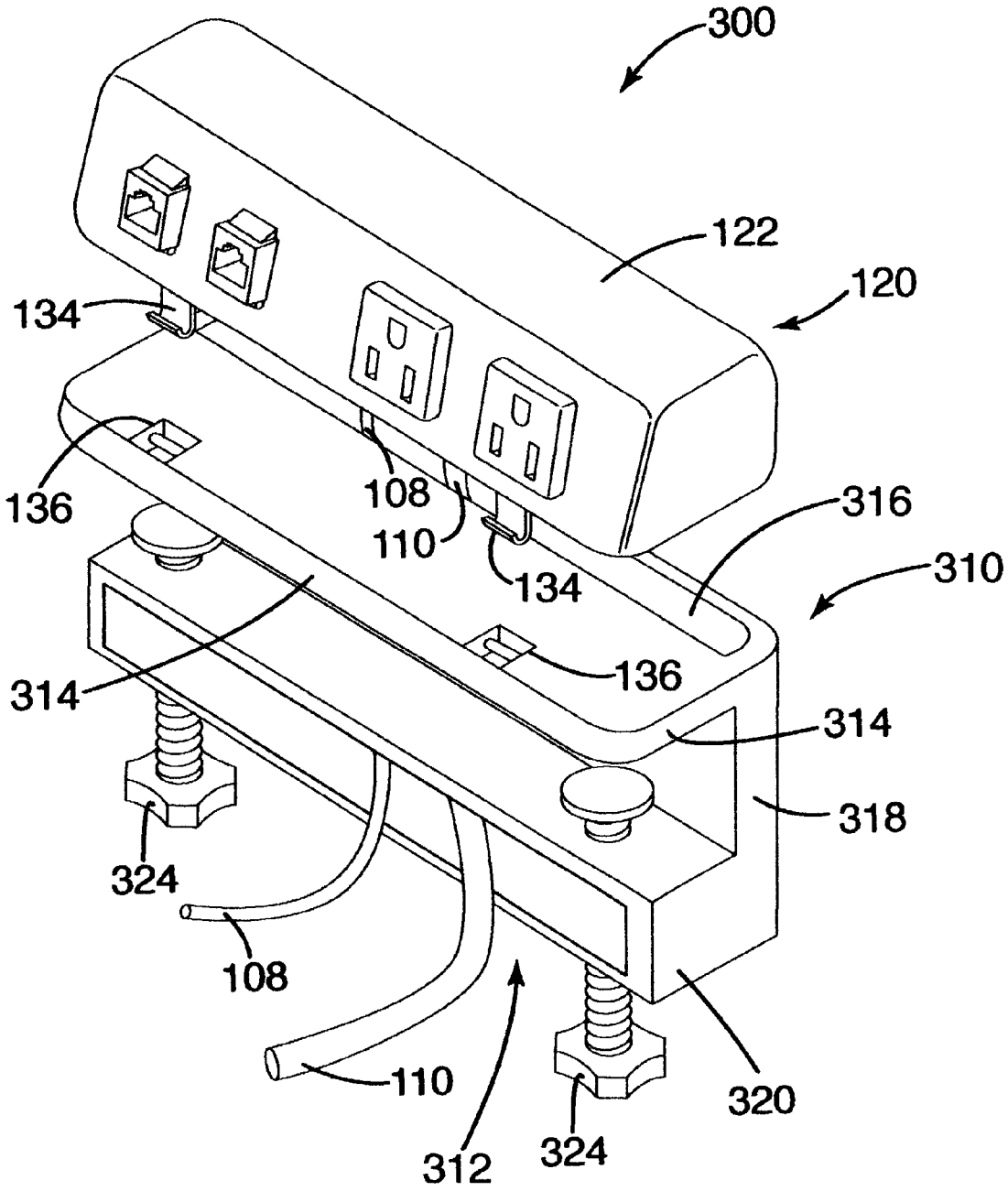
FIG. 12 is an exploded view of the energy center shown in FIG. 9, and illustrating the separate components comprising the energy center upper housing and the base support.
Figure 13:
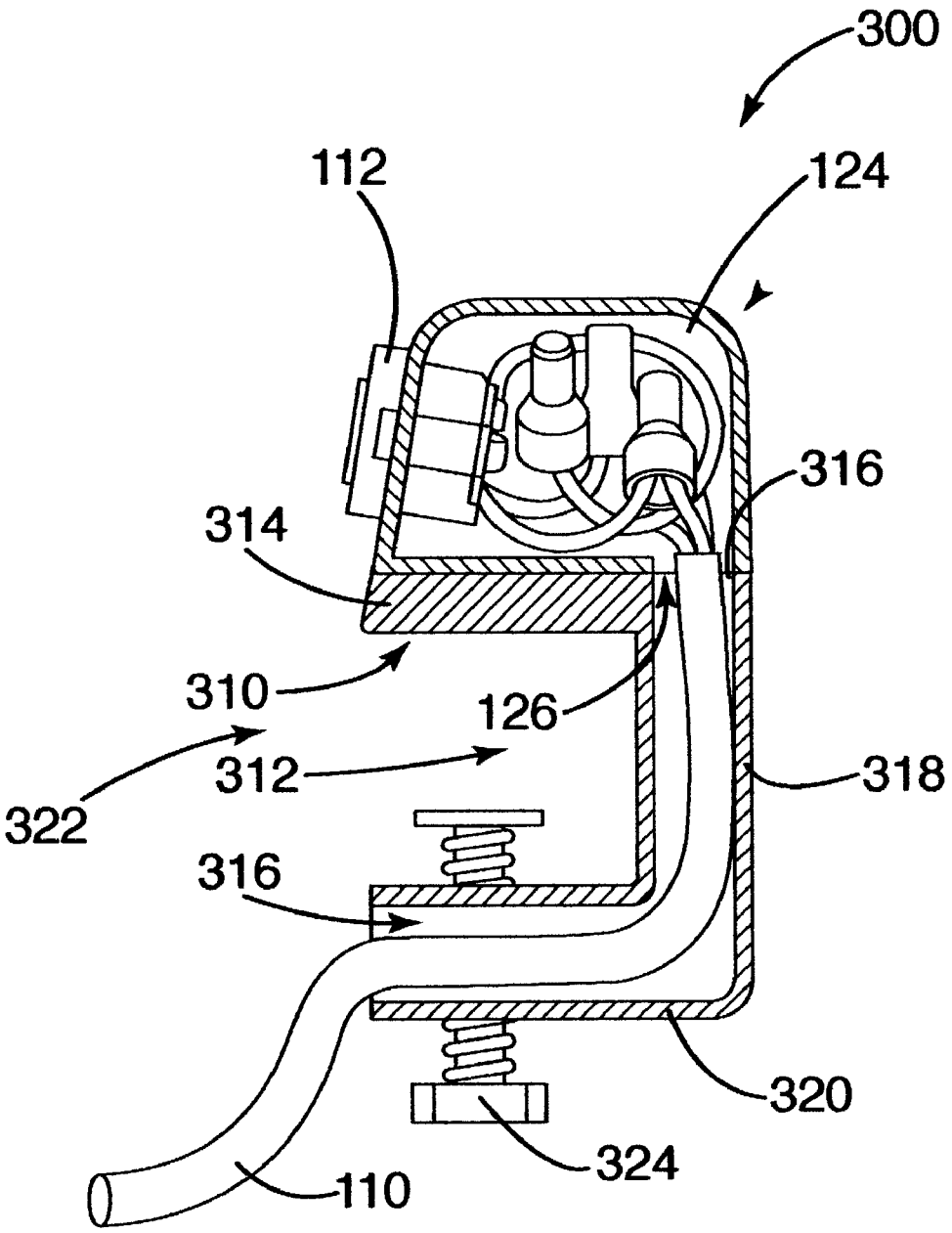
FIG. 13 is a sectional side view of the energy center of FIG. 9, taken along section lines 13—13 of FIG. 15.
Figure 14:
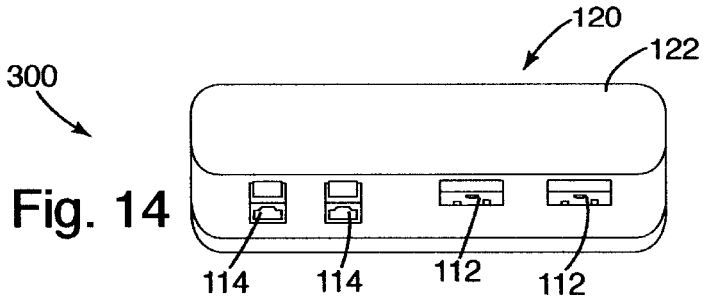
FIG. 14 is a plan view of the energy center shown in FIG. 9.
Figure 15:
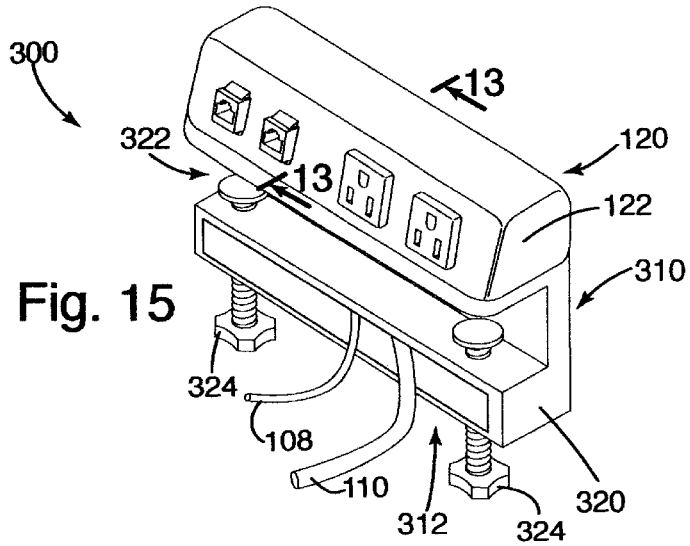
FIG. 15 is a perspective view of the energy center shown in FIG. 9.
Figure 16:
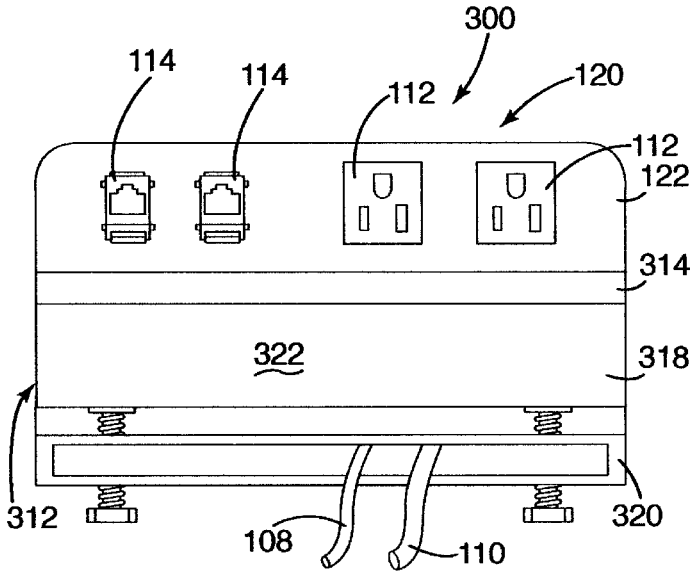
FIG. 16 is a front elevational view of the energy center shown in FIG. 9.
Figure 17:
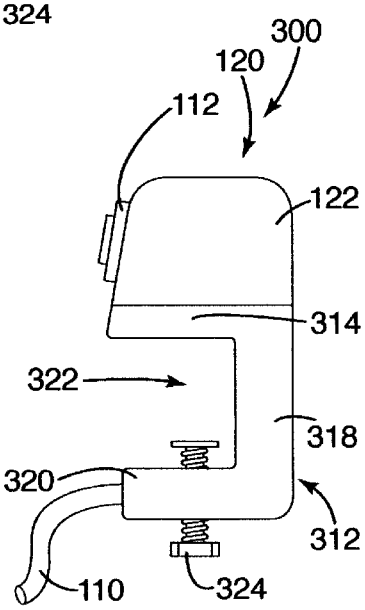
FIG. 17 is a side elevational view of the energy center shown in FIG. 9.

With reference to several of the drawings, but primarily FIGS. 12 and 13, the energy center 300, unlike the energy center 100, includes a second base support 310 which is in the form of a clamping device 312 utilized for purposes of releasably securing the energy center 300 to an edge of the work surface 102. More specifically, the energy center upper housing 120, as with the energy center 100, includes a pair of hooks 134 which are adapted to be releasably secured to hook retainers 136 mounted within the clamping device 312. As with the energy center 100, the hooks 134 and hook retainers 136 provide a means for releasably securing the energy center upper housing 120 to the base support comprising the clamping device 312.

The hook retainers 136 are located within a portion of the clamping device 312 comprising an upper cantilever section 314. The cantilever section 314 comprises an upper planar section having a slot 316 through which the power cords 110 and data lines 108 may extend. The slot 316 is formed at the rear portion of the clamping device 312 and upper cantilever section 314, and opens into the spacial area 124 and aperture portion 126.

The upper cantilever section 314 is connected to or preferably integral with an interconnecting vertical portion 318 extending downwardly from the cantilever section 314. The slot 316 extends through the interconnecting section 318. Connected to or otherwise preferably integral with the lower portion of the interconnecting section 318 is a lower clamp section 320 which extends forwardly from the interconnecting section 318. The lower clamping section 320, interconnecting section 318 and upper cantilever section 314, form a slot 322 which opens forwardly. The slot 322 is appropriately configured and sized so that it is adapted to receive an edge of the work surface 102 as illustrated primarily in FIGS. 9, 10, and 11. For purposes of releasably securing the clamping device 312 to the work surface 102, appropriate clamping screws 324 may be employed.

Also of interest and importance is the positioning of the power cords 110 and data lines 108 through the clamping device 312. As primarily shown in FIG. 13, the slot 316 extends not only through the interconnecting section 318, but also extends in a horizontal manner and forwardly through the lower clamping section 320. In this manner, the power cords 110 and data lines 108 can still be brought forwardly so as to be positioned below the work surface 102, rather than being extended downwardly but out from under the protective area of the work surface 102. However, other types of slotting and guidance arrangements for the power cords 110 and data lines 108 can be utilized, without departing from the primary principal concepts of the invention.

In accordance with the foregoing, a particular advantage of an energy center in accordance with the invention is the interchangeability of the base supports. With the particular embodiments illustrated and described herein, the energy center upper housing 120 is adapted to be utilized with the base support 130 and the base support 310. In this manner, the energy centers 100 and 300 can utilize the same energy center upper housing 120, whether the energy center is to be used on the planar surface 104 of the work surface 102, or otherwise releasably secured to the edge of the work surface 102 (as shown with respect to the energy center 300). It should also be noted that with the particular embodiments described herein, it is unnecessary to utilize any particular tools for purposes of assembly and disassembly of the energy centers with their supporting devices.

It will be apparent to those skilled in the pertinent arts that other embodiments of energy centers in accordance with the invention can be achieved. That is, the principles of an energy center in accordance with the invention are not limited to the specific embodiments described herein. For example, other types of releasable securing means can be utilized to secure the upper housings of the energy centers to the base supports. It will be apparent to those skilled in the art that modifications and other variations of the above-described illustrative embodiments of the invention may be effected without departing from the spirit and scope of the novel concepts of the invention.

The embodiments of the invention in which an exclusive property or privilege is claimed are defined as follows:

1. An energy center adapted to be mounted to a desk or other furniture item having a planar work surface, or a vertical side surface, said energy center comprising:

one or more electrical and/or voice/data receptacles and communication terminals;

an upper housing for housing said receptacles and communication terminals;

one or more power cords coupled to said receptacles and communication terminals, and extending downwardly from said upper housing for purposes of supplying energy to said receptacles and communication terminals;

a first base support adapted to be releasably coupled to said upper housing, and further adapted to be mounted over a slot on a planar portion of said work surface;

a second base support, adapted to be mounted to an edge of said planar work surface or said vertical side surface; and said upper housing is adapted to be releasably coupled interchangeably to said first base support and, alternatively, said second base support, without requiring tools for coupling and uncoupling said upper housing to and from either said first base support or said second base support.

2. An energy center in accordance with claim 1, characterized in that said second base support comprises a structural configuration different from a structural configuration of said second base support.

3. An energy center in accordance with claim 1, characterized in that said energy center further comprises a grommet structure receivable within said slot, and said first base support is securable to said grommet structure.

4. An energy center in accordance with claim 1, characterized in that said power cords are substantially hidden from view during use of said energy center.

5. An energy center in accordance with claim 1, characterized in that said energy center further comprises cord slots formed in said first base support, while providing a means for extending power cords and data lines from atop said planar surface.

6. An energy center in accordance with claim 1, characterized in that said upper housing comprises:

an outer shell;

an interior spacial area for housing appropriate electrical wires and portions of said receptacles and communication terminals; and an open slot area through which power cords and data lines access said interior spacial area.

7. An energy center in accordance with claim 1, characterized in that said first base support comprises:

a shell portion adapted to be releasably mounted to said upper housing; and hook retainers mounted to an interior surface of said shell portion.

8. An energy center in accordance with claim 1, characterized in that said energy center further comprises connecting means mounted to said first base support and to said upper housing for releasably securing said first base support to said upper housing.

9. An energy center in accordance with claim 1, characterized in that said upper housing comprises:

an outer shell;

an interior spacial area for housing electrical wires and portions of electrical receptacles and data ports;

an open slot area through which power cords and data lines may access said interior spacial area; and connecting hooks mounted to a lower frontal portion of said outer shell.

10. An energy center in accordance with claim 1, characterized in that said second base support comprises:

an upper cantilever section, having an upper planar section with a slot through which power cords and data lines may extend;

an interconnecting vertical portion extending downwardly from said upper cantilever section, with said slot extending through said interconnecting portion;

a lower clamp section extending forwardly from said interconnecting section; and said lower clamp section, interconnecting section and upper cantilever section forming a slot which opens forwardly, and is appropriately configured in size so as to receive an edge of said work surface.

11. An energy center in accordance with claim 10, characterized in that said second base support further comprises clamping screws for clamping said second base support to an edge of said planar work surface or said vertical side surface.

12. An energy center in accordance with claim 10, characterized in that said second base support further comprises hook retainers located within said upper cantilever section.

* * * * *